United States Patent [19]

Satoh et al.

[11] Patent Number: 5,011,019

[45] Date of Patent: Apr. 30, 1991

[54] CONTAINER FOR PACKAGING MEDICINE

[75] Inventors: Toyomi Satoh, Tokyo; Kiyonori Hosoi, Kanagawa; Katsuji Kinoshita, Kanagawa; Shinjiro Murata, Kanagawa; Shunzo Fukatsu, Tokyo; Tooru Ichikawa, Saitama, all of Japan

[73] Assignee: Kabushiki Kaisha Hosokawa Yoko, Tokyo, Japan

[21] Appl. No.: 439,590

[22] Filed: Nov. 20, 1989

[30] Foreign Application Priority Data

Nov. 21, 1988 [JP] Japan ..... 63-294404

[51] Int. Cl.[5] ..... B65D 83/04

[52] U.S. Cl. ..... 206/530; 206/484.1; 206/484.2; 206/524.2; 206/524.3; 428/905; 383/116

[58] Field of Search ..... 206/528, 524.2, 524.3, 206/524.6, 524.9, 484.1, 484.2; 428/905; 383/116

[56] References Cited

U.S. PATENT DOCUMENTS

| | | | |
|---|---|---|---|
| 3,553,296 | 1/1971 | Gaeckel | 428/905 X |
| 3,567,119 | 3/1971 | Wilbert et al. | 206/524.3 |
| 4,145,001 | 3/1979 | Weyenberg et al. | 206/484.2 |
| 4,497,406 | 2/1985 | Takanashi | 206/524.6 |
| 4,588,090 | 5/1986 | Spuck et al. | 206/524.9 |
| 4,634,614 | 1/1987 | Holzner | 206/484.2 |
| 4,865,371 | 9/1989 | Egberg | 206/524.3 |

FOREIGN PATENT DOCUMENTS

| | | | |
|---|---|---|---|
| 0148020 | 10/1985 | European Pat. Off. . | |
| 1359348 | 3/1964 | France | 383/116 |
| 151451 | 6/1988 | Japan . | |
| 1384556 | 2/1975 | United Kingdom . | |

*Primary Examiner*—William I. Price

*Attorney, Agent, or Firm*—Ladas & Parry

[57] ABSTRACT

A container for packaging a medicine, which comprises a plastic sheet for accommodating a medicine therein, the plastic sheet having an olefin layer into which a deodorizing agent is mixed to remove foul odor emitted from the medicine therein.

5 Claims, 1 Drawing Sheet

CONTAINER FOR PACKAGING MEDICINE

BACKGROUND OF THE INVENTION

This invention relates to a container for packaging a medicine, and more particularly to a container which has a moisture proof and can absorb odoriferous ingredient emitted from a medicine accommodated therein to prevent foul or offensive odor from being emitted outside of the container.

In medicines generally used, especially oral medicines, a property of being easily soluble in water (a high water solubility) is given to them in view of necessity for dissolving them in a stomach, and a moisture proof is required for a container for such medicines.

If the container for the medicines does not have a sufficient moisture proof, moisture in the air passes through the container for medicines to enter the container and to react on the medicines accommodated therein to cause discloration of the medicines and decrease of effect of the medicines.

Press Throught Packaging (PTP) is, at present, mainly used for packaging medicines because of economy due to its compactness and facility of use by patients.

A container obtained by PTP comprises a plastic sheet having a medicine accommodating portion and an aluminum foil sheet which is attached to the plastic sheet in a manner to cover the medicine accommodating portion of the plastic sheet. With respect to medicines for which a high moisture proof is not so required, a polyvinyl chloride sheet is used. With respect to medicines for which a moisture proof is required, a polyvinylidene chloride coating polyvinyl chloride sheet is used.

Among medicines accommodated in PTP container, some medicines emit carbonic acid gas, hydrogen sulfide gas, trimethylacetic acid gas and the like. Carbonic gas emitted from medicines is odorless, and hydrogen sulfide gas and trimethylacetic acid gas emit offensive odor, respectively.

In a plastic sheet, including vinyl chloride, for a PTP container, a gas permeable resistance is relatively high, and a moisture proof is, however, low to cause medicines accommodated in the container to react on moisture whereby the medicines are discolored and effect of medicines are decreased.

In a plastic sheet, including polyvinylidene chloride coating polyvinyl chloride, for a PTP container, a moisture proof is high, and however a gas permeable resisitance is not high. Therefore, in case that medicines emitting gas are eneveloped in the container, gas emitted from the medicines cannot easily pass through the plastic sheet, and the inner pressure of the medicine accommodating portion is increased. Resultantly, there may be a case wherein a seal portion is broken due to expansion of the medicine accommodating portion.

In a plastic sheet, including polypropylene, for a PTP container, a moisture proof and a gas permeability are high to overcome the above problems. However, since the plastic sheet including polypropylene has a good gas permeability, in case that hydrogen sulfide gas or trimethylacetic acid gas is emitted from medicines enveloped in the container, offensive or foul odor is emitted near a place where the medicines are stored to influence environment badly and to give an unpleasant feeling to patients.

SUMMARY OF THE INVENTION

It is an object to provide a container for packaging medicines which has a moisture proof and absorbs odorous ingredients emitted from the medicines enveloped in the container thereby to prevent emittance of offensive or foul odor.

According to this invention, there is provided a container for packaging a medicine therein, which comprises a laminated sheet including an olefin layer into which a deodorizing agent is mixed, said laminated film forming at least a part of the container.

The nature, utility, and further features of this invention will be more clearly apparent from the following detailed description with respect to preferred embodiments of the invention when read in conjunction with the accompanying drawings described below.

DETAILED DESCRIPTION OF THE INVENTION

Figure 1:
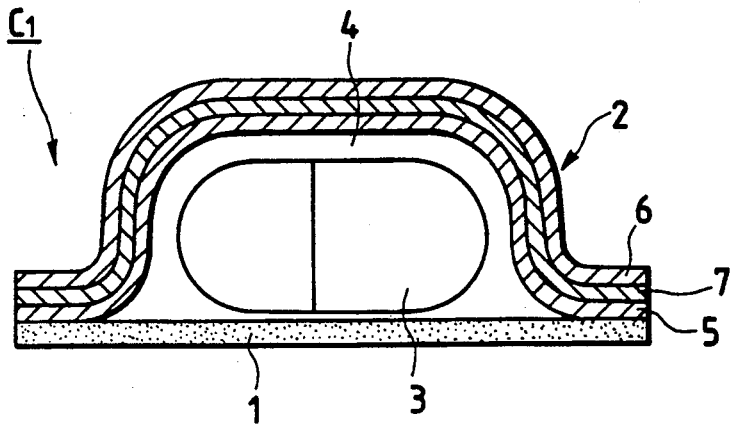
FIG. 1 is an elevational sectional view of a container for packaging medicines in case that the container according to this invention is adapted for a PTP container.

FIG. 1 shows a container $C_1$ for packaging a medicine 3 according to this invention. The container $C_1$ is formed by PTP (Press Throught Packaging) method. The container $C_1$ comprises a flat aluminum foil sheet 1 and a plastic sheet 2 cooperating with the aluminum foil sheet to envelope the medicine 3 therein. The plastic sheet 2 is so formed as to have a space 4 for accommodating the medicine 3 in the form of a capsule or tablet. The plastic sheet 2 and the aluminum foil sheet 1 are attached to each other at positions around the space 4 by means of an adhesive or heat sealing.

The plastic sheet 2 is a laminated film which has an intermediate polyethylene layer 7 into which a deodorizing agent (deodorizer) is mixed and which is sandwiched between an inner layer 5 and an outer layer 6, each of which comprises a polypropylene film. Instead of polyethylene layer 7, other olefin layers may be used. The thicknesses of the three layers 5, 6 and 7 are e.g., 20μ, 300μand 50μ, respectively. As deodorizing agents, flavonoid, molecular sieve and inorganic metal salt are preferable.

In such a container $C_1$, a gas ingredient emitted from the medicine 3 accommodated in the medicine accomodating space 4 of the PTP container passes through the inner layer 5 of the polypropylene film having a high gas permeability without passing through the aluminum foil sheet 1 which does not permit a gas to pass therethrough. The gas having passed through the inner layer 5 reaches the intermediate polyethylene layer 7, and foul or offensive odor ingredients included in the gas are absorbed or neutralized to resolve by a deodorizing agent mixed into the intermediate polyethylene layer 7 thereby to remove foul odor emitting gas ingredients such as a hydrogen sulfide gas and a trimethylacetic acid gas. Thereafter, a gas from which the foul odor ingredients are removed passes through the outer polypropylene layer 6 to be emitted outside. In the container $C_1$, the thickness of the inner polypropylene layer 5 is determined relatively thin in comparison with that of the outer polypropylene layer 6 thereby to lengthen residence time of the gas in the intermediate polyethylene layer 7. This lengthens the time when the gas is subjected to absorption and neutralization resolution of the gas by the deodorizing agent and increase efficiency of deodorization.

Figure 2:
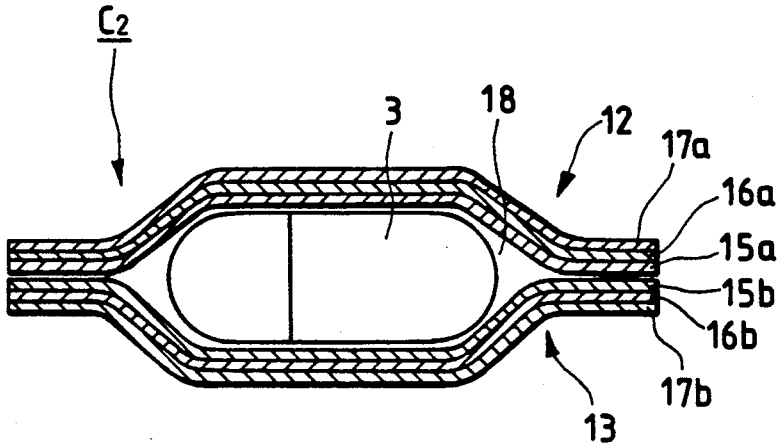
FIG. 2 is an elevational sectional view of a container for packaging medicines, showing another embodiment of this invention.

FIG. 2 shows another embodiment of this invention. In FIG. 1, as a container for packaging medicines, a PTP Type container is used. However, as shown in FIG. 2, the medicine 3 may be enveloped in the space 18 of a bag-like container $C_2$ which comprises two plastic sheets 12 and 13, each of which has the same construction as that of the plastic sheet 2 of FIG. 1. The portions around the space 18 of each plastic sheet are heat-sealed in a state wherein the inner layers 15*a* and 15*b* of polypropylene are opposed to each other. Each of intermediate layers 16*a* and 16*b* of polyethylene includes a deodorizing agent, and two outer layers 17*a* and 17*b* of polypropylene are attached to the two intermediate layers 16*a* and 16*b*, respectively. Further, the deodorizing agents are not limited to the above flavonoid, molecular sieve and inorganic metal salt, and other deodorizing agents may be mixed into the intermediate layers.

In accordance with the increases of the amount of foul odor gas emitted from medicines enveloped in a container, the mixing ratio of a deodorizing agent into the polyethylene layer may be increased or the thickness of the polyethylene layer including a deodorizing agent is increased. In addition, a deodorizing agent may be mixed into the outer polypropylene film. In case that a gas with a remarkably bad smell is emitted in large quantities, it is effective that the PTP container is accommodated into a bag which is formed with a laminated sheet comprising a polypropylene film and a polyethylene layer into which a deodorizing agent is mixed.

According to this invention, the intermediate polyethylene layer into which a deodorizing agent is mixed absorbs foul odor ingredients emitted from medicines enveloped into the container and prevents the foul odor from being emitted outside. Accordingly, since emittance of foul odor does not occur near a place where the container is stored, there is no undesirable influence to environment and an uncomfortable feeling is not given to patients.

Furthermore, as the polyproplylene film has a moisture proof, medicines eneveloped into the container do not discolor and the effect of the medicines does not decrease.

What is claimed is:

1. A container for packaging a medicine therein comprising a laminated sheet including an olefin layer into which a deodorizing agent is mixed, said laminated sheet forming at least a part of the container and said laminated sheet comprising an inner polypropylene layer opposed to a medicine accommodated in the container, an intermediate olefin layer of polyethylene and an outer polypropylene layer, said olefin layer being sandwiched between the inner and outer polypropylene layers.

2. A container according to claim 1, wherein said container comprised a flat aluminum foil sheet and said laminated sheet with a space for accommodating said medicine, said laminated sheet being attached to said aluminum foil sheet at positions around said space to envelope said medicine.

3. A container according to claim 1, wherein said container comprises two laminated layers each including an olefin layer, which are joined with each other to form a space for accommodating a medicine.

4. A container according to claim 1, wherein said inner polypropylene layer is relatively thin in comparison with that of said outer polypropylene layer.

5. A container according to claim 4, wherein the thickness of said inner, intermediate and outer layers are 20μ, 50μand 300μ, respectively.

* * * * *